US005092986A

United States Patent [19]

Feistner et al.

[11] Patent Number: 5,092,986

[45] Date of Patent: Mar. 3, 1992

[54] MAGNETIC SEPARATOR

[75] Inventors: Klaus Feistner, Stolberg-Dorff; Gerd Fassbender, Köln, both of Fed. Rep. of Germany

[73] Assignee: Steinert Elektromagnetbau GmbH, Fed. Rep. of Germany

[21] Appl. No.: 342,180

[22] Filed: Apr. 24, 1989

[30] Foreign Application Priority Data

Apr. 25, 1988 [DE] Fed. Rep. of Germany ..... 3813906
Jul. 14, 1988 [DE] Fed. Rep. of Germany ..... 3823944

[51] Int. Cl.[5] ..... B03C 1/18
[52] U.S. Cl. ..... 209/212; 209/219
[58] Field of Search ..... 209/212, 219, 218, 223.2

[56] References Cited

U.S. PATENT DOCUMENTS 1,462,584 7/1923 Smith ..... 209/219 X
3,448,857 6/1969 Benson et al. ..... 209/212
3,887,458 6/1975 Lavrila ..... 209/219

FOREIGN PATENT DOCUMENTS 139650 6/1934 Belgium ..... 209/219
191492 8/1906 Fed. Rep. of Germany ..... 209/219
74168 6/1977 Japan ..... 209/212

*Primary Examiner*—Donald T. Hajec
*Attorney, Agent, or Firm*—Anthony J. Casella; Gerald E. Hespos

[57] ABSTRACT

A magnetic separator is provided in which a conveyor belt is conducted over a belt drum to transport relatively electrically conductive particles. A magnetic system consisting of permanent magnets or electromagnets is rotated at a high speed at an eccentric location within the belt drum so that an air gap between the outer surface of the magnet system and the inner surface of the belt drum is not constant. As a result, the magnetic lines of force lose their influence on an iron particle coming between the belt drum and the conveyor belt. These iron particles can be removed from the belt drum or the conveyor belt by scrapers to avoid damage to the belt drum.

9 Claims, 1 Drawing Sheet

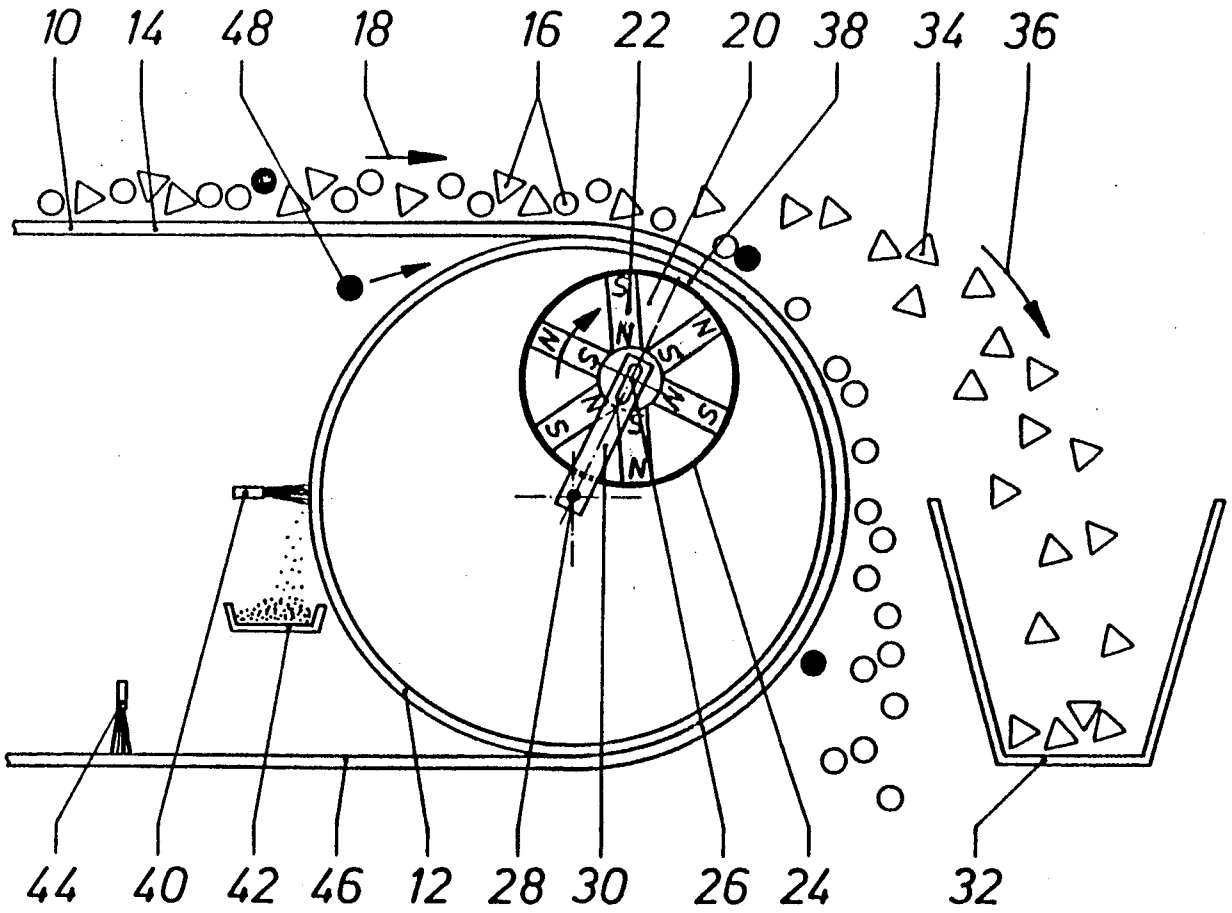
36
34
38
20
22
16
18
48
14
10
32
24
26
30
28
12
46
42
40
44
N
S

MAGNETIC SEPARATOR

BACKGROUND OF THE INVENTION

The invention relates to a magnetic separator having a conveyor belt conducted over a belt drum of electrically nonconductive material for the transport of the fraction to be sorted which consists of particles of relatively good electrical conductivity, having a magnet system which can be driven in rotation inside the belt drum at a speed higher than that of the belt drum, and having a collecting container arranged behind the belt drum for the electrically conductive particles separated out.

Such a device is known from U.S. Pat. No. 3,448,857. In this known device, a magnet system arranged inside a drum rotates within the belt drum at a speed of about 1500 rpm, while the conveyor belt conveys the fraction to be sorted to the belt drum and thus to the magnet system at a speed of 1 m/sec to 1.5 m/sec. The drum in which the magnet system is arranged has an outside diameter which corresponds approximately to the inside diameter of the belt drum, and a small constant air gap is developed between magnet system and belt drum. During operation, a relative movement is produced between the conveyor belt and the drum in which the magnet system is contained, and this difference in speed has the result that the magnetic lines of force intersect the electrically conductive particles fed on the conveyor belt, whereby currents are induced the strength of which depends on the electrical conductivity of the particles. In the particles of greater electrical conductivity a stronger current is produced which has the result that these particles follow a trajectory into the collecting container arranged in front of the belt drum. Particles of lower electrical conductivity, on the other hand, remain near the conveyor belt and fall off the conveyor belt shortly before the collecting container.

Despite extensive precautionary measures, it can happen that a ferromagnetic particle comes between the conveyor belt and its belt drum. It is also possible for such a particle to come between the belt drum and the conveyor belt through a worn place in a conveyor belt. These ferromagnetic particles are held fast due to the magnetic force and rotate on the belt drum. In order not to impair the effect of the magnetic system, the belt drum must consist of a nonconductive material. As a rule, the belt drum of such a system consists of plastic. Such plastic material, however, will melt even at relatively low temperatures. A magnetizable electrically conductive particle, i.e. an iron particle, which is stuck between conveyor belt and belt drum, is heated so strongly by the alternating magnetic field of the magnet system that it begins to glow. In this condition, the particle may work its way through the plastic of the belt drum and pass into the air gap between the outer surface of the magnet system and the inner surface of the belt drum. This may then result in severe damage to the device since the rapidly rotating magnet system entrains the iron particle and, for example, slits open the circumferential wall of the belt drum. This results in the shutting down of the system and expensive repair.

The object of the invention is to develop a magnetic separator of the type described, in such a manner that damage to the belt drum as a result of particles coming between the conveyor belt and the belt drum are avoided.

SUMMARY OF THE INVENTION

This object is achieved in accordance with the invention in the manner that the outside diameter of the magnet system is substantially less than the inside diameter of the belt drum and that the magnet system is arranged eccentrically in the belt drum.

If, in the permanent magnet separator in accordance with the invention, an iron particle comes between the belt drum and the belt, it is clamped between the belt drum and the belt and in this way, it is true, initially conducted past the rapidly rotating magnet system; however, it cannot be held fast by the latter but is, rather, upon the rotation of the belt drum, necessarily conducted a greater distance away from the magnet system. In this way, the influence of the magnetic lines of force on the iron particle becomes so slight that it either adheres to the belt drum or drops onto the lower course of the conveyor belt.

Scrapers are preferably arranged on the outside of the belt drum between the upper and the lower course of the conveyor belt and/or on the inside of the lower course of the conveyor belt behind the belt drum so that iron particles which come between the conveyor belt and the belt drum can be scraped off from the belt drum or the lower course of the conveyor belt and conducted away. A damaging of the belt drum by the enclosed iron particle is thus excluded.

In accordance with a preferred embodiment, the magnet system can be swung around the center of the belt drum so that the relative position between magnet system and belt drum can be adjusted with simple means and maintenance can, for instance, be facilitated.

The air gap between drum wall and magnet system is preferably adjustable.

The diameter of the magnet system is preferably half as large as the diameter of the belt drum so that the magnet system can be swung 360° around the center of the belt drum.

The magnet system can consist of permanent or electromagnets.

One embodiment of the invention will be described in greater detail below on basis of the drawing.

BRIEF DESCRIPTION OF THE DRAWING

The FIGURE is a side elevational view of the magnetic separator of the subject invention.

DETAILED DESCRIPTION OF THE PREFERRED EMBODIMENT

The FIGURE shows a conveyor belt 10, which is conducted over a belt drum 12. A fraction of relatively electrically conductive particles 16 is arranged on the upper course 14 of the conveyor belt 10 and is transported at a speed of about 1 m/sec to 1.5 m/sec on the conveyor belt 10 in the direction of the arrow 18. The belt drum 12 consists of electrically nonconductive material, for instance a plastic.

Within the belt drum 12 there is arranged a magnet system 20 with permanent magnets or electromagnets 22 which are provided in a cylindrical drum 24. The cylindrical drum 24 of the magnet system 20 has about half the diameter of the belt drum 12. The center 26 of the cylindrical drum 24 is arranged eccentrically to the center 28 of the belt drum 12. The cylindrical drum 24 with the magnets 22 is swingable by means of arms 30 around the center 28 of the belt drum 12. In order to separate particles of good electrical conductivity from particles of less electrical conductivity in an optimal manner, the magnet system 20 is arranged in the position shown in the FIGURE. The magnet system 20 rotates around the center 26 at a speed of about 1500 rpm.

A container 32 is arranged in front of the belt drum 12, the particles 34 of good electrical conductivity falling in said container. During transport on the conveyor belt 10, the magnetic lines of force of the magnet system 20 intersect the belt drum 12, the conveyor belt 10 and the electrically conductive particles 16 fed on the conveyor belt. In this way, currents are induced in the electrically conductive particles which currents are stronger in the case of particles of good electrical conductivity than in the case of particles of lesser electrical conductivity. The particles of good electrical conductivity are then accelerated onto a trajectory which is indicated by the arrow 36. The less conductive particles remain near the conveyor belt and fall down between it and the container 32. An air gap 38 is developed between the outer surface of the cylindrical drum 24 of the magnet system 20 and the upper course 14 of the conveyor belt 10, the air gap changing continuously due to the eccentric arrangement of the magnet system 20 in the belt drum 12. On the outer surface of the belt drum 12, opposite the magnet system 20 arranged in the belt drum 12, there is a scraper 40 and a collecting container 42 arranged below it. Another scraper 44 is provided on the inner surface of the lower course 46 of the conveyor belt 10. The air gap 38 between the belt drum 12 and the magnet system 20 is infinitely adjustable by displacing the center 26 of the magnet system 20 along the slot 50 in the arm 30.

If an iron particle 48 comes between the inner side of the conveyor belt 10 and the outside of the drum 12 for any unforeseeable and undesired reason, then a current is induced in said particle by the action of the magnetic lines of force of the magnetic field 20 and the iron particle 48 is entrained on the outer surface of the belt drum 12, as the result of the higher speed of rotation of the magnet system 20, until, after sufficient rotation of the belt drum 12, the distance between the iron particle 48 arranged on its outside surface and the magnet system 20 becomes so large that the magnetic lines of force lose their influence on the iron particle 48. If the iron particle 48 continues to adhere to the belt drum 12, it can be scraped off by the scraper 40 and deposited in the collecting container 42. If the particle drops down before this from the outer surface of the belt drum 12 onto the lower course 46, then it is removed by the scraper 44 from the space between upper and lower course of the conveyor belt 10. The eccentric arrangement of the magnet system 20 in the belt drum 12 and the smaller diameter of the magnet system 20 prevent an iron particle 48 which comes between belt drum 12 and conveyor belt 10 being entrained by the magnet system at a speed which is greater than that of the belt drum 12, so that, due to the fact that the iron particle 48 does not experience any extensive heating as a result of the influence of the magnet system 20, any damaging of the belt drum 12, i.e. a slitting open thereof by the iron particle 48, is excluded.

We claim:

1. A magnetic separator having a conveyor belt guided over a belt drum of electrically nonconductive material for the transport of a fraction to be sorted which comprises particles of relatively good electrical conductivity and particles of lesser conductivity, and having a magnet system of generally cylindrical shape which is driven for rotation inside the belt drum at a speed higher than that of the belt drum, the magnet system inducing currents in the particles, with said currents being stronger for particles in the fraction having good conductivity than for particles in the fraction of lesser conductivity, such that the particles of good electrical conductivity are accelerated into a trajectory separated from the particles of lesser conductivity, and a collecting container disposed in selected spaced relationship from the belt drum for receiving particles of good electrical conductivity separated out, characterized by the fact that the outside diameter of the magnetic system (20) is substantially less than the inside diameter of the belt drum (12) and that the magnet system (20) is arranged eccentrically in the belt drum (12).

2. A magnetic separator according to claim 1, characterized by the fact that the magnet system (20) is arranged for swinging around the center (28) of the belt drum (12).

3. A magnetic separator according to claim 1, characterized by the fact that the diameter of the magnet system (20) is about half as large as the diameter of the belt drum (12).

4. A magnetic separator according to claim 1, wherein the conveyor belt defines opposed upper and lower courses, said separator being characterized by the fact that scrapers (40, 44) are arranged outside of the belt drum (12) between the upper course (14) and the lower course (46) of the conveyor belt (10) and/or on the inside of the lower course (46) of the conveyor belt (10) behind the belt drum (12).

5. A magnetic separator according to claim 1, characterized by the fact that an air gap (38) exists between the belt drum (12) and the magnet system (20), the eccentric disposition of the magnet system (20) in the belt drum (12) being adjustable for adjusting the size of the air gap therebetween.

6. A magnetic separator according to claim 1, characterized by the fact that the magnet system (20) comprises permanent magnets.

7. A magnetic separator according to claim 1 characterized by the fact that the conveyor belt includes opposed upper and lower courses, with the lower course including an inside surface facing the upper course, said magnetic separator further comprising at least one scraper adjacent the inside surface of the lower course of the conveyor belt and in spaced relationship to the belt drum.

8. A magnetic separator according to claim 1 characterized by the fact that the magnet system comprises electromagnets.

9. A magnetic separator having a rotatable drum of electrically nonconductive material for the transport of a fraction to be sorted which comprises particles of relatively good electrical conductivity and particles of lesser conductivity, and having a magnet system of generally cylindrical shape which is driven for rotation inside the drum, the magnet system inducing currents in the particles, with said currents being stronger for particles in the fraction having good conductivity than for particles in the fraction of lesser conductivity, such that the particles of good electrical conductivity are accelerated into a trajectory, separated from the particles of lesser conductivity, and a collecting container disposed in selected spaced relationship from the drum for receiving particles of good electrical conductivity separated out, characterized by the fact that the outside diameter of the magnetic system is substantially less than the inside diameter of the drum and that the magnet system is arranged eccentrically in the drum.

* * * * *